US007673478B2

(12) United States Patent
Krauss et al.

(10) Patent No.: US 7,673,478 B2
(45) Date of Patent: Mar. 9, 2010

(54) NEEDLE BED WITH FLUID CHANNELS

(75) Inventors: Rainer Krauss, Zell (DE); Matthias Seeger, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/314,280

(22) Filed: Dec. 8, 2008

(65) Prior Publication Data

US 2009/0145171 A1 Jun. 11, 2009

(30) Foreign Application Priority Data

Dec. 8, 2007 (EP) ..... 07023817

(51) Int. Cl.
*D04B 35/30* (2006.01)

(52) U.S. Cl. ..... 66/8

(58) Field of Classification Search ..... 66/114, 66/115, 116, 123

See application file for complete search history.

(56) References Cited

U.S. PATENT DOCUMENTS 3,545,233 A * 12/1970 Lombardi ..... 66/8
3,817,058 A * 6/1974 Lombardi ..... 66/8
5,129,240 A * 7/1992 Schindler ..... 66/8
5,609,044 A * 3/1997 Tacy ..... 66/115

* cited by examiner

*Primary Examiner*—Danny Worrell
(74) *Attorney, Agent, or Firm*—Fitch, Even, Tabin & Flannery; Norman N. Kunitz

(57) ABSTRACT

A needle bed (1) that comprises strips (4) in order to form needle channels (5), with the strips being configured in a comb-like manner. Between the individual teeth of this comb, recesses (28 through 37) are formed, said recesses being disposed to supply fluid to the needle channel (5) and to drain said fluid. The groove (12) that accommodates the strip (4) forms a distributor space where the distribution of the fluid to be supplied to the knitting tools takes place over a section of the strip (4), which section is preferably greater than half the length of the strip.

15 Claims, 6 Drawing Sheets

Fig.4

NEEDLE BED WITH FLUID CHANNELS

CROSS-REFERENCE TO RELATED APPLICATION

The present application claims the priority of European Patent Application No. 07 023 817.5, filed Dec. 8, 2007, the subject matter of which, in its entirety, is incorporated herein by reference.

BACKGROUND OF THE INVENTION

The invention relates to a needle bed for a knitting machine.

Knitting machines have been known, for example, designed as circular knitting machines or as flat-bed knitting machines. While the latter comprise at least one essentially flat needle bed, the needle beds of circular knitting machines are designed as hollow cylinders acting as knitting cylinders or in a ring-shaped manner to represent rib dials. Each needle bed has needle channels into which are set the knitting tools such as, for example, needles or sinkers. During operation, the knitting tools are moved back and forth in the needle bed.

German Patent Document DE 24 16 626 A1 discloses such a needle bed and also teaches to provide the needle bed with grooves extending in a direction transverse to the needle channels and to blow an air/oil mixture through bores into these grooves. The groove walls that delimit the guide channels of the knitting tools may be provided with recesses, so that the lubricant may better spread between the knitting tools and their guide channels.

Considering this arrangement, it is quite difficult to maintain control over the spreading of the lubricant in the needle bed.

German Patent Document DE 1 635 836 A discloses a knitting cylinder as well as a rib dial in a circular knitting machine. Both may be provided with annular grooves that intersect the guide grooves of the knitting tools. Pressurized air may be blown into the cam ring through these annular grooves.

Furthermore, the injection of pressured air into the needle bed has been known from document DD 37 345 A, whereby the pressurized air is to prevent the accumulation of debris in the cam area of the affected knitting machine.

Pressurized air is a process medium that, when used, is connected with considerable operating costs. Therefore, one objective must be to lower the amount of pressurized air required for the operation of a knitting machine.

Furthermore, the accumulation of debris in the needle beds of knitting machines represents a problem that promotes wear and shortens maintenance intervals. Consequently, it must be an objective to avoid the accumulation of debris in the needle carriers of knitting machines.

Also, with increasing operating speeds of knitting machines, the reliability of the lubrication of the knitting tools becomes of importance. Knitting tools that run partially dry result in an increased use of energy and in wear of the knitting tool and of the knitting machine.

Considering this, it is the object of the invention to produce a knitting machine displaying improved air supply.

SUMMARY OF THE INVENTION

The above object is achieved with the needle bed that displays the features of Claim 1:

The needle bed in accordance with the invention may be designed as a knitting cylinder, a rib dial, a flat bed or as a similar needle carrier of a loop-forming machine. Said needle bed comprises a base element having one surface that is provided with a plurality of grooves as well as with a fluid channel that extends in a direction transverse to the longitudinal direction of the grooves and, preferably, at one end of the grooves. Strips are set into the grooves that—between them—form guide grooves for the knitting tools. Each of the strips has a number of recesses that create a fluid connection between the fluid channel and the guide grooves.

On its side seated in the groove, i.e., on its underside, the strip has several recesses similar to a comb, the depth of said recesses being slightly greater than the depth of the grooves provided in the base element. (In so doing, the "depth" is measured perpendicular to the groove, i.e., in radial direction in the case of a knitting cylinder.) Most of these tooth-like projections do not touch the groove bottom of the needle carrier. As a result of this, a flow channel extending in longitudinal direction inside the groove is created, whereby said channel can be used for dispensing a fluid such as, for example, dry pressurized air, oil-containing pressurized air or a similar fluid, into the needle channel in the desired distribution along the length of the strip. Thus, most of the tooth-like projections hover over the groove bottom of the needle carrier. The thickness of the strip and its teeth is preferably consistent with the groove width at each point of the strip. The upper side of the strip is preferably closed, i.e., does not have any recesses. Preferably, the strip is delimited at the top by a surface that is narrow, straight, continuous and strip-shaped.

A preferred embodiment may have several fluid channels performing different functions. For example, a first fluid channel is located in the immediate vicinity of the receiving grooves for the channel strips, as has already been described. This fluid channel has the form of a circling groove and can act as a distributor groove. A second fluid channel may be provided within the base element and communicate via a connecting channel, preferably several connecting channels, with the first fluid channel.

The front and the rear ends, respectively, are used for supporting and adjusting the strips inside the groove.

In addition, one of the tooth-like projections may touch—between its front end and its rear end of the strip—the bottom of the groove in order to effect a flow interruption, i.e., a barrier between the recesses. This tooth-like projection thus divides the recesses into two groups, namely, a first group that communicates with the fluid-conducting channel and a second group that communicates with a fluid-draining channel, for example. As a result of this, a well-controlled fluid flow can be achieved in each needle channel, said flow supplying to the knitting tool—in the desired distribution—the required fluid, for example, oil-carrying pressurized air, and again draining the optionally debris-loaded fluid at a desired location. In this manner, dirt particles, fuzz, abraded material, excess lubricant and the like that had entered the needle channel can be drained in a controlled manner.

Consequently, the invention permits the controlled and adequate lubrication of knitting tools, on the one hand, as well as prevents knitting tools and needle channels from being soiled, and lubricant from being carried into the environment, or prevents lubricant from excessively contaminating knit material with lubricant, on the other hand.

As a result of the controlled supply of the fluid to the knitting tool through an array of recesses in the strips, the required amount of fluid is reduced to a minimum. This is successful because, due to the controlled distribution of the fluid over the length of the knitting tool, both an uncontrolled escape and an excess of fluid at specific points are avoided, and a lack of fluid at another point is also avoided.

Additional details of advantageous embodiments of the invention are the subject matter of the drawing, the description and the subclaims.

The description is restricted to essential aspects of the invention and other existing situations. The drawings disclose additional details and are thus to be used as a supplementary reference. The description and the drawings represent exemplary embodiments of the invention.

DETAILED DESCRIPTION OF THE INVENTION

Figure 1:
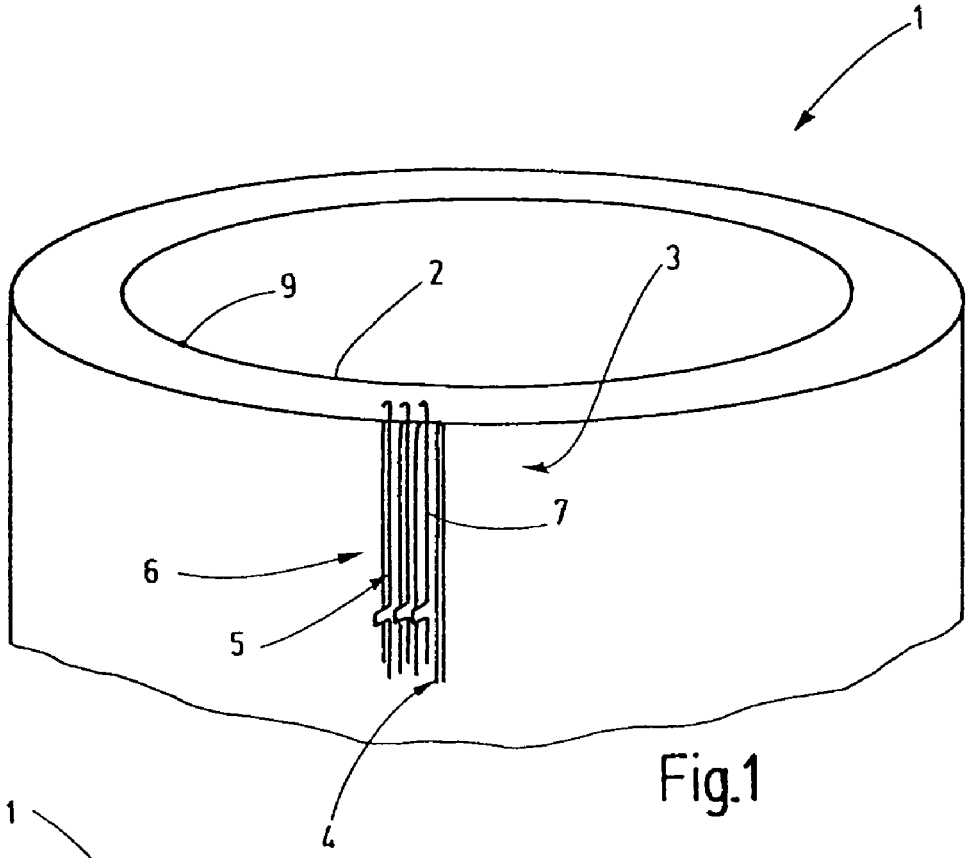
FIG. 1 is an extremely schematic diagram showing the principle of a knitting cylinder with knitting tools.

FIG. 1 shows a needle bed 1 in the form of a knitting cylinder 2. The knitting cylinder 2 has, on its outside circumference, an essentially cylindrical surface 4 from which strips 4 extend essentially in radial direction. In so doing, the strips 4 are oriented in longitudinal direction relative to the knitting cylinder. Preferably, these strips are configured as flat sheet metal pieces with flat lateral surfaces that are parallel to each other. However, the strips 4 may also have different shapes, e.g., have the shape of a slim wedge. Together, the two lateral surfaces subtend an acute angle.

The needle channels 5 are formed between the strips 4, whereby, in accordance with FIG. 1, knitting tools 6, e.g., in the form of needles 7, are arranged between said channels. Consequently, each needle channel 5 is delimited by two lateral surfaces of two strips 4. The surface 3 forms the bottom of the needle channels 5.

Figure 2:
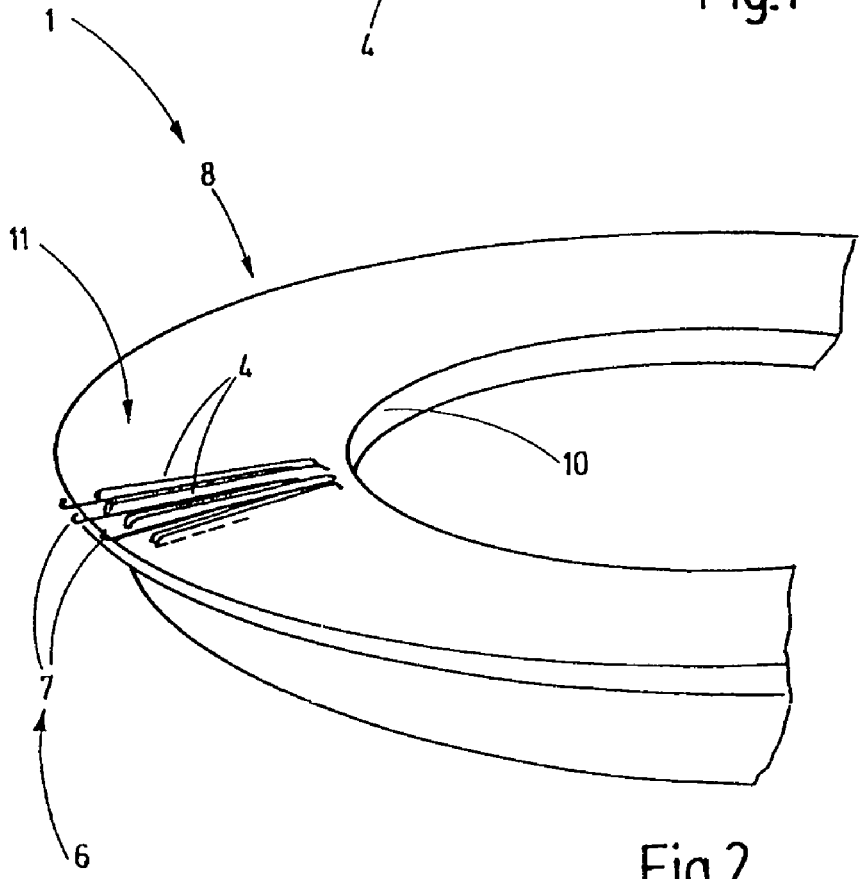
FIG. 2 is a perspective schematic view of a detail showing the principle of a rib dial.

In the case, in which the inventive needle bed is implemented as a rib dial 8, as shown by FIG. 2, the circumstances are similar. While the knitting cylinder in accordance with FIG. 1 comprises an approximately hollow cylindrical base element 9, the base element 10 of the rib dial 8 consists of a flat ring. Its essentially flat upper side represents an annular surface 11 on which the strips 4 are arranged, whereby the needles 7 or other knitting tools 6 such as sinkers are located between said strips.

Figure 3:
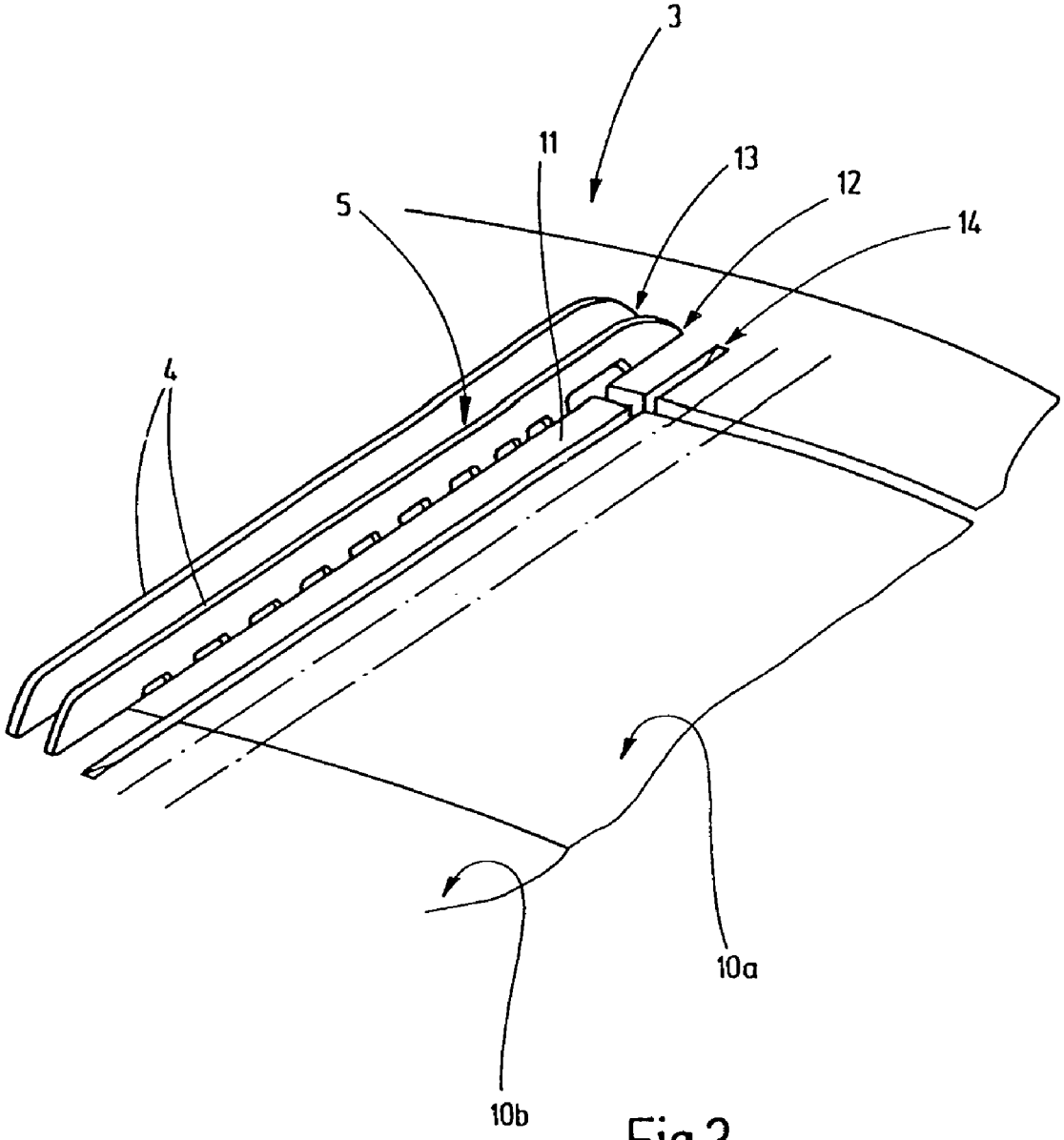
FIG. 3 is an enlarged schematic view of a detail showing the principle of a rib dial in accordance with FIG. 2.

Additional details are illustrated by FIG. 3. In accordance with this, the grooves 12, 13, 14 and so on are provided in the surface 3 or 11, said grooves being disposed to accommodate the strips 4. The strips 4 are secured in the grooves 12, 13, 14 and thus form the lateral walls of the needle channels 5, the surface 3 or 11 forming the bottom of said needle channels.

Figure 4:
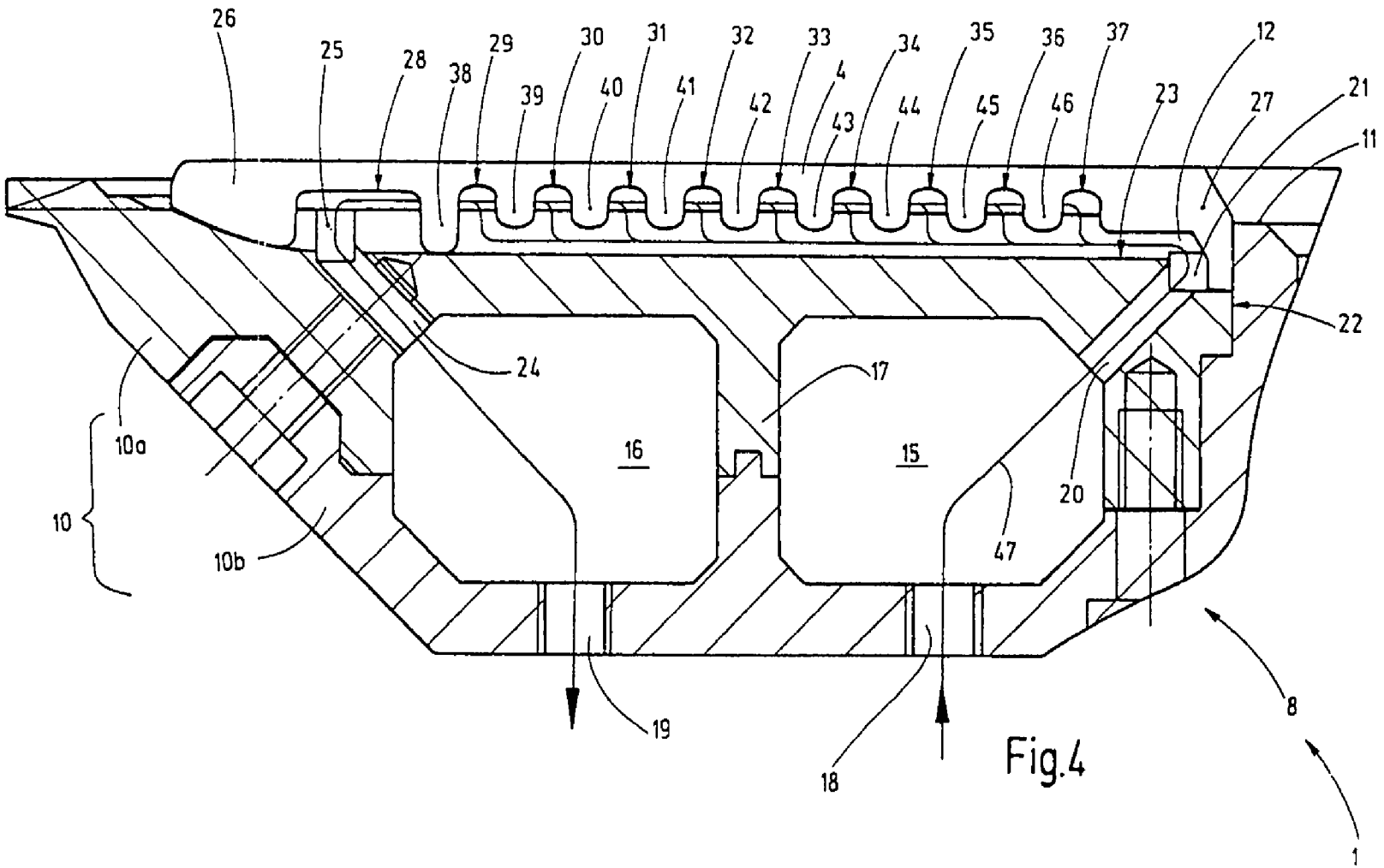
FIG. 4 is a vertical sectional view of the rib dial in accordance with FIGS. 2 and 3.

As illustrated by FIG. 4 with the use of the example of the rib dial 8, the base element 10 is composed of at least two annular components 10*a*, 10*b*. The two components 10*a*, 10*b* are joined together and secured to each other, as indicated, e.g., by screws or other connecting means. They delimit between them two annular fluid channels 15, 16 that are separated from each other by a dividing wall 17. The fluid channels 15, 16 may be provided with connections 18, 19 in order to feed and drain fluids such as, for example, pressurized air or the like.

Extending from the fluid channel 15 is a connecting channel 20 to a distributor groove 21 that is configured, e.g., as a ring groove and is arranged concentrically with respect to the ring-shaped base element 10. The ring groove 21 intersects all grooves 12, 13, 14. Preferably, the component 10*a* has a number of such connecting channels 20 that connect the distributor groove 21 to the fluid channel 15 at several, preferably at many, different, points. Preferably the distributor groove 21 is covered, i.e., it does not reach the surface 11 representing the bottom of the guide grooves of the knitting tools. This can be achieved, for example, in that the distributor groove 21, as shown by FIG. 4, extends from a surface 22 and is an integral part of the component 10*a*, whereby the surface 22—in assembled state—is covered by the component 10*b*. In so doing, the distributor groove 21 is at a level at which it cuts all grooves, e.g., 12, 13, 14, i.e., said distributor groove extends beyond their groove bottom 23.

The fluid channel 16 that is preferably disposed to drain fluid communicates, via at least one, preferably more, connecting channels 24, with a distributor groove 25 that acts as a collecting groove that is preferably arranged concentrically with respect to the distributor groove 21. While the distributor groove 21 is arranged at one end of the groove 12, the distributor groove 25 is arranged at its other end. The distributor groove 25 is machined into the surface 11 and is thus open toward the needle channels 5.

The strips 4 are preferably shaped the same relative to each other. Preferably, they have the shape of thin planar flat elements that are set erect in the grooves 12, 13, 14. Said flat elements' ends 26, 27 abut against the bottom 23 of the groove 12 or against other fitting or alignment surfaces of the base element 10, and thus positioning the strip 4.

The strip 4 is provided with a number of recesses 28 through 37, between which projections having the form of teeth 38 through 46 are provided. The recesses 28 through 37 take away material from the lower edge of the strip 4, said edge being seated in the groove, and have a size such that they project beyond the surface 11 when the strip 4 is seated in the groove 12. The teeth 38 through 46 seated in the recesses 38 through 46 have a length such that they sink into the groove 12. Preferably, at least one tooth 38 has a length such that it touches or almost touches the groove bottom 23. Consequently, it represents a barrier that essentially prevents the fluid flow along the groove 12. Preferably, the remaining teeth 39 through 46 are shorter so that they do not reach the groove bottom 23. Consequently, the long tooth 38 divides the recesses 28 though 37 into two groups: a first group (29 through 37) that communicates with the fluid-supplying distributor groove 21 and a second group 28 that communicates with the fluid-draining distributor groove 25.

The needle bed 1 described so far works as follows:

During operation, the knitting tools 6 seated in the needle channels 5 between the strips 4 are moved back and forth in longitudinal direction (in FIG. 4, from left to right and from right to left). A desired fluid, for example, oil-carrying pressurized air, cooling air, cleaning air, is supplied continuously or discontinuously via the fluid channel 15. In so doing, the fluid flows along the path indicated by a line 47 in FIG. 4 into the groove 12 and along said groove up to the tooth 28. On its way, it supplies the individual recesses 29 through 37 in order to flow—via the windows that are open toward the needle channel 5—into said needle channel. In so doing, the needle channel 5 is evenly supplied with fluid, for example, lubricating fluid, along a large length of the strip 4. This fluid thus flows in an orderly manner to the knitting tool. Via the longer recess 28—with respect to the longitudinal direction of the strip 4—and the collecting groove 25, the fluid may then be evacuated again through the fluid channel 16. In so doing, the fluid may carry with it any particles, fuzz, abraded material and the like out of the needle channel.

As explained, the air/oil mixture arrives in an orderly manner in the needle channels and at the loop-forming tools. As a result of the evacuating effect of the collecting channel 25 and the fluid channel 16, the oil/air mixture is discharged again, together with fiber dust, abraded material and so on. A defined circulation occurs.

The balance between air supply and air discharge can be selected in such a manner that a slight excess pressure prevails at all times in the region of the loop-forming components, so that dust and debris are kept away.

Figure 5:
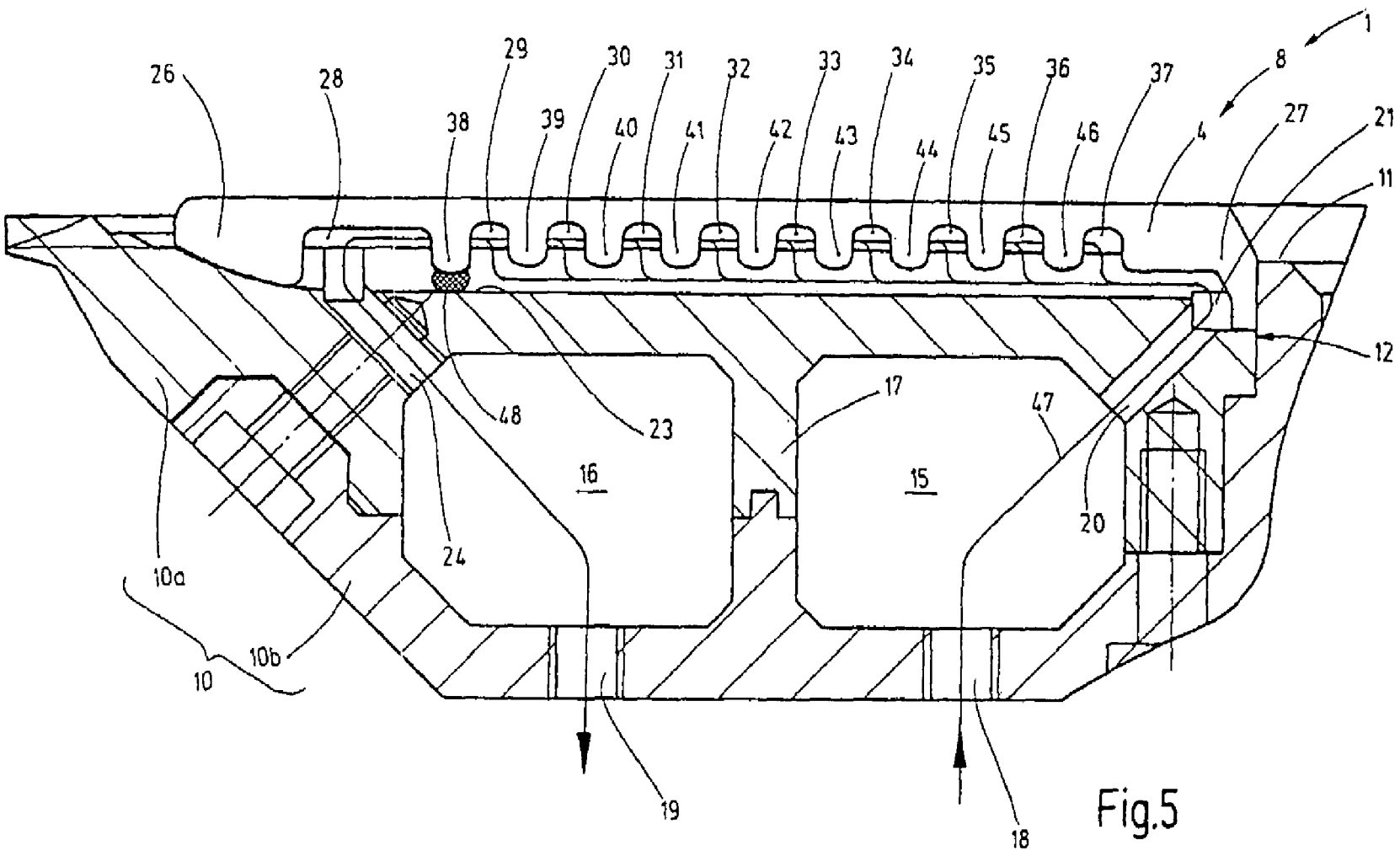
FIGS. 5 and 6 are modified embodiments of the rib dial in accordance with FIG. 4.

The invention may be modified in numerous ways. For example, as shown by FIG. 5, the tooth 38 may be shortened or sealed by a separate seal 48 that is interposed between the tooth 38 and the groove bottom 23.

Figure 6:
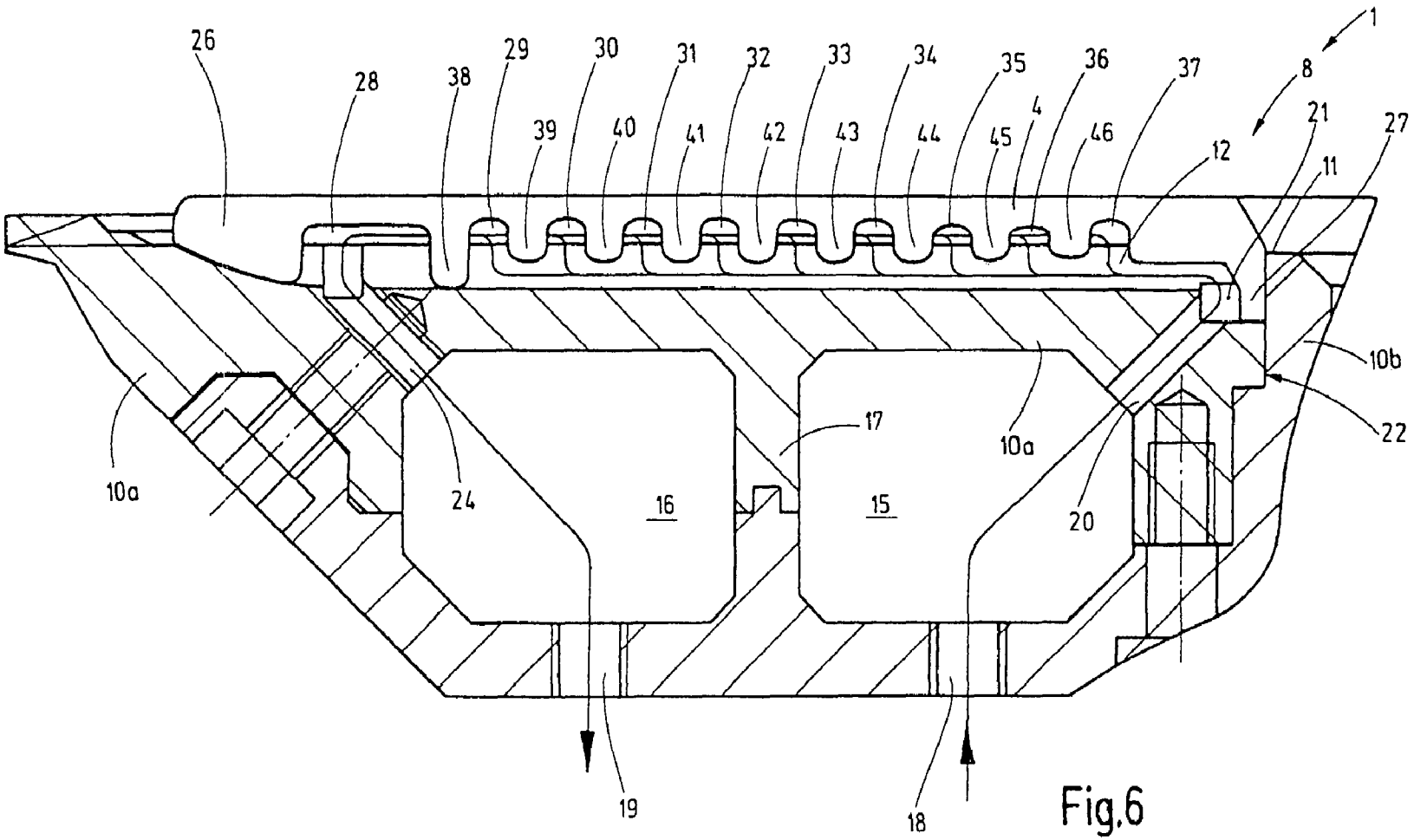

In addition, it is possible, as shown by FIG. 6, to configure the individual recesses 28 through 37 so as to be different from each other and to configure the recesses in the form of teeth 38 through 46 so as to have different lengths. In this manner, e.g., a uniform distribution of the air or the oil/air mixture can be obtained. Also, a specific distribution profile can be adjusted as desired. For example, the flow rate of the grooves 12, 13, 14 can be reduced with increasing distance, starting from the distributor groove 21. This can be ensured in that either the volume of the grooves 12, 13, 14 in the base element 10 decreases with increasing distance from the supply site, e.g., by reducing the groove depth or in that the volume of the strip sections extending into the grooves 12, 13, 14 increase with increasing distance from the supply site, i.e., the distributor groove 21. The configuration of the recesses and of the teeth may vary along the strip 4 regarding their form, in particular, regarding the length as well as regarding the width, in such a manner that, across the entire length of the strip 4, the amount of air directed at the respective location of the loop-forming element is the same at each location.

In addition, the distribution of the air or the oil/air mixture can be optimized in that the volume of the fluid channels 15, 16 is adapted to existing flow situations, i.e., in that the volume of the fluid channels, in particular the fluid channel 15, through which the air or the oil/air mixture is supplied, is reduced starting from the connection 18. It is also possible that the volume of the fluid channel 15 enlarges starting from the connection 18, should this permit an optimization of the existing flow situations. The same applies analogously to the fluid channel 16.

As previously mentioned, it is possible to configure all the strips of the needle bed 1 as described above. Furthermore, it is possible to provide, alternately, a conventional strip without teeth and recesses and a strip with teeth and recesses in order to supply the air/oil mixture to the individual needle channels on only one side.

Figure 7:
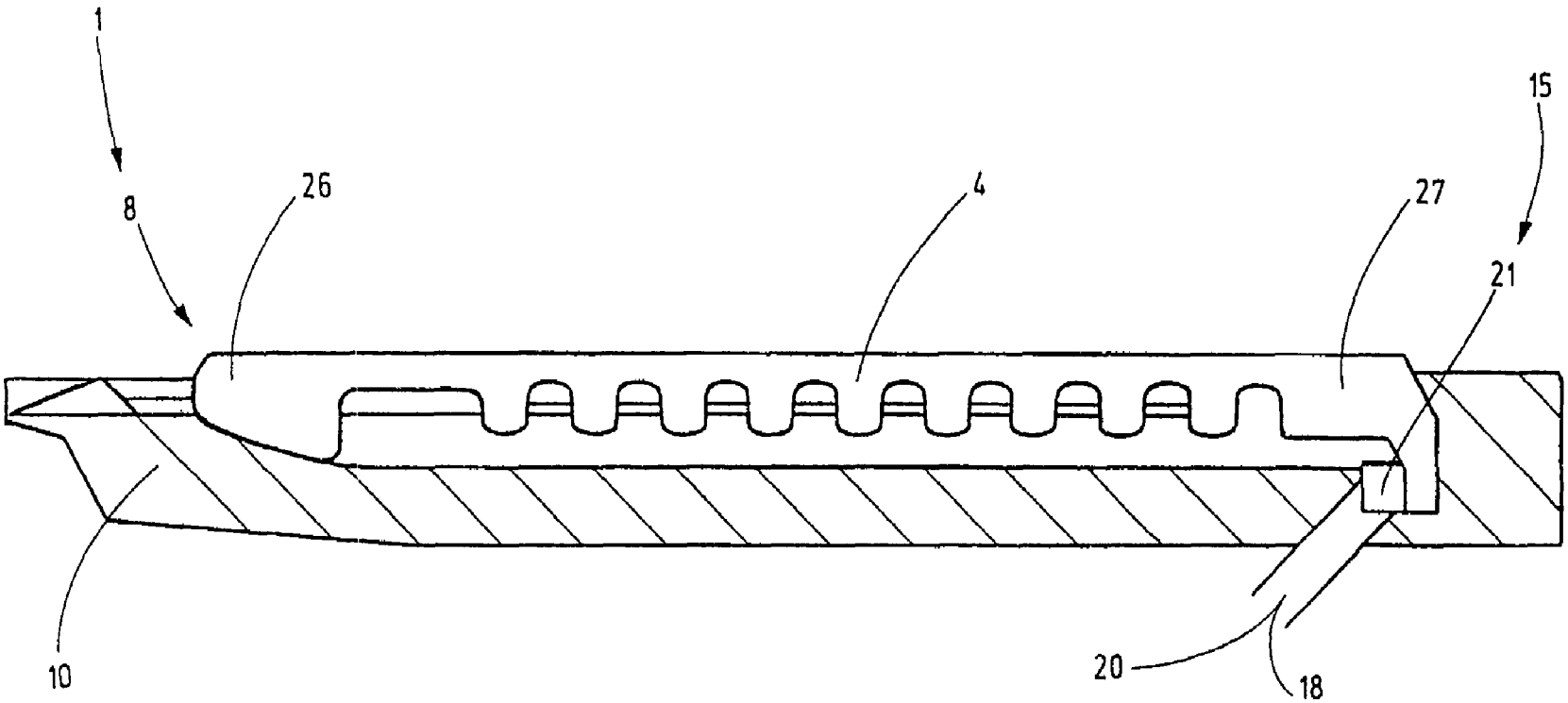
FIG. 7 is a view of a detail showing the principle of a modified embodiment of a rib dial in accordance with the invention.

FIG. 7 shows a modified exemplary embodiment. The embodiment of the needle bed 1 shown by this figure has a particularly space-saving form that is particularly suitable for small circular knitting machines and flat-bed knitting machines. In so doing, the needle bed 1 may comprise only one fluid channel 15 in the form of the known distributor groove 21. This fluid channel 15 is directly supplied with the air/oil mixture through a connection 18 or a connecting channel 20. Considering this exemplary embodiment, there is no fluid channel 16 or connecting channel 24, however, these may optionally be provided in order to enable or support the evacuation of the fluids.

The needle bed 1 in accordance with the invention comprises strips 4 in order to form needle channels 5, said strips being configured in a comb-like manner. Between the individual teeth of this comb, recesses 28 through 37 are formed, said recesses being disposed to supply fluid to the needle channel 5 and to drain said fluid. The groove 12 that accommodates the strip 4 forms a distributor space where the distribution of the fluid to be supplied to the knitting tools takes place over a section of the strip 4, said section being preferably greater than half the length of said strip.

It will be appreciated that the above description of the present invention is susceptible to various modifications, changes and modifications, and the same are intended to be comprehended within the meaning and range of equivalents of the appended claims.

LIST OF REFERENCE NUMERALS

1 Needle bed
2 Knitting cylinder
3 Surface
4 Strips
5 Needle channels
6 Knitting tools
7 Needle
8 Rib dial
9, 10 Base element
10*a*, 10*b* Components
11 Surface
12, 13, 14 Grooves
15, 16 Fluid channels
17 Dividing wall
18, 19 Connections
20 Connecting channel
21 Distributor groove
22 Surface
23 Groove bottom
24 Connecting channel
25 Distributor groove/collecting groove
26, 27 Ends
28-37 Recesses
38-46 Teeth
47 Line
48 Seal

We claim:

1. Needle bed for a knitting machine, said needle bed comprising:

a base element having at least one fluid channel and being provided, on one surface, with grooves that communicate with the fluid channel, strips set into the grooves in order to form, between each other, guide grooves for knitting tools, each of said strips having a number of recesses creating a fluid connection between the fluid channel and the guide grooves, and projections formed between the recesses, with said projections immersing into the grooves but not touching their bottoms.

2. Needle bed for a knitting machine in accordance with claim 1, wherein the base element has connecting channels which connect the grooves to the fluid channel.

3. Needle bed for a knitting machine in accordance with claim 1, wherein the base element has several fluid channels.

4. Needle bed for a knitting machine in accordance with claim 3, wherein the bass element consists of at least two components which, between them, delimit the fluid channels.

5. Needle bed for a knitting machine in accordance with claim 4, wherein the base element has at least two fluid channels that are separate from each other.

6. Needle bed for a knitting machine in accordance with claim 1, wherein the fluid channel has connections in order to supply and/or drain fluids, wherein the volume of the fluid channel changes starting from the connection.

7. Needle bed for a knitting machine in accordance with claim 1, wherein the volume of the fluid channel decreases starting from the connection.

8. Needle bed for a knitting machine in accordance with claim 1, wherein the recesses of the strips set in the grooves extend beyond the surface.

9. Needle bed for a knitting machine in accordance with claim 1, wherein the projections have different shapes, in particular different lengths and/or widths.

10. Needle bed for a knitting machine in accordance with claim 1 wherein the recesses of the strips are arranged in a row that extends over a section of the length of the respective strip.

11. Needle bed for a knitting machine in accordance with claim 1, wherein a fluid barrier is provided between at least two of the recesses of a strip.

12. Needle bed for a knitting machine in accordance with claim 1, wherein each of the strips has two ends which are held in the grooves in a fluid-tight manner.

13. Needle bed for a knitting machine in accordance with claim 1, wherein at least one of the connecting channels communicates with a distributor channel or collecting channel which is oriented in a direction transverse to the grooves and intersects said grooves.

14. Needle bed for a knitting machine, said needle bed comprising:

a base element having at least one fluid channel and being provided, on one surface, with grooves that communicate with the fluid channel, and strips set into the grooves in order to form, between each other, guide grooves for knitting tools, with each of said strips having a number of recesses creating a fluid connection between the fluid channel and the guide grooves, and wherein the base element has several fluid channels and consists of at least two components which, between them, delimit the fluid channels.

15. Needle bed for a knitting machine in accordance with claim 14, wherein the base element has at least two fluid channels that are separate from each other.

* * * * *